United States Patent [19]

Ndebi

[11] Patent Number: 4,908,670

[45] Date of Patent: Mar. 13, 1990

[54] WICK FOR FIXING ROLLER

[75] Inventor: Sylvain L. Ndebi, Rochester, N.Y.

[73] Assignee: Eastman Kodak Company, Rochester, N.Y.

[21] Appl. No.: 208,626

[22] Filed: Jun. 20, 1988

[51] Int. Cl.[4] ..... G03G 15/20

[52] U.S. Cl. ..... 355/284; 118/258; 118/264

[58] Field of Search ..... 355/3 FU, 14 FU, 284; 219/216; 118/60, 101, 258–260, 264, 70, 266

[56] References Cited

U.S. PATENT DOCUMENTS

| | | | |
|---|---|---|---|
| 2,957,448 | 10/1960 | Dynia | 118/259 |
| 3,964,431 | 6/1976 | Namiki | 118/60 |
| 3,996,888 | 12/1976 | Lotdahl et al. | 118/70 |
| 4,375,201 | 3/1983 | Kato | 118/264 Y |
| 4,757,347 | 7/1988 | Tamaoki et al. | 355/284 |

FOREIGN PATENT DOCUMENTS

| | | | |
|---|---|---|---|
| 58-209770 | 12/1983 | Japan | 355/3 FU |
| 61-245178 | 10/1986 | Japan | 355/3 FU |

*Primary Examiner*—Joan H. Pendegrass
*Attorney, Agent, or Firm*—Leonard W. Treash

[57] ABSTRACT

An internally fed rotating wick for applying release liquid to a fixing roller surface includes a disposable feed tube having small apertures through which the liquid can pass. A strip of soft porous capillary fabric is wound around the feed tube and contacts the feed tube on its inside and is contactable with the roller surface on its outside. The feed tube itself has relatively thick walls and large internal diameter. The apertures in the feed tube are preferably in the form of very narrow slits having a long dimension either parallel to or slanted with respect to the wick axis. In one embodiment, the feed tube has a closed end and means on the opposite end for attaching to a liquid feed means.

13 Claims, 4 Drawing Sheets

12
14
21
3
18
11
13
14
2
4
13
12
11
4
4
30
30

WICK FOR FIXING ROLLER

TECHNICAL FIELD

This invention relates to roller fixing of the type used in electrophotographic copiers and printers. More specifically, this invention relates to a wicking structure for the application of release liquid to the surface of a roller in a roller fixing device.

BACKGROUND ART

U.S. Pat. No. 4,429,990 granted to E. J. Tamary, Feb. 7, 1984 discloses a wicking structure for applying release liquid to the surface of a roller in a roller fixing apparatus. Release liquid, commonly referred to as "oil," is transported under pressure from a container to a permanent internal feed tube located inside a replaceable porous applicating wick. The feed tube and wick constitute a wicking or application roller which, when in contact with the fixing roller, is rotated by it while it "oils" the surface. This structure has many advantages including ease in articulation, efficient and rapid application of oil in response to an appropriate signal and quite low wear on the fixing roller surface.

The structure shown in that patent is commonly called a "rotating wick" and has been adopted commercially in a number of copiers. The release liquid is delivered to the wicking structure using a pump through a feed means to the permanent, rotatable feed tube. The feed tube is cylindrical and has small holes drilled or punched along its elongated side walls through which liquid can pass. The replaceable wick surrounds the feed tube. It is installed by being pulled over the free end of the feed tube. The replaceable wick is a porous structure which includes an inner ceramic porous material that is covered by a porous and heat-resistant fabric such as wool or a comparable synthetic fabric. Such a synthetic fabric is marketed by DuPont under the trademark Nomex® and is a well known capillary fabric which is resistant to heat and used for a variety of fusing roller wicks.

As mentioned above, these wicking structures have been successful commercially. However, maintenance is complicated by the cost associated with the replaceable portion of the wick and by occasional clogging of the holes in the feed tube which clogging is not necessarily cleared merely by replacing the wicking structure.

DISCLOSURE OF THE INVENTION

It is the object of this invention to provide a wicking structure generally of the type described but which is more reliably and less expensively maintained.

This and other objects are accomplished by including as part of the disposable wicking structure a disposable feed tube which is attachable to the end of the feed means. The tube contains apertures, preferably in the form of narrow slits, through which the liquid can pass. A soft porous capillary fabric is wrapped directly around and in contact with the feed tube. The external surface of the wrapped fabric is contactable with the fixing roller surface.

The feed tube and the wrapped fabric form an integrated unit which is replaced as a unit eliminating any problem with clogged feed holes in a permanent feed tube. The ceramic porous material is eliminated resulting in a structure that is less expensive than prior replacement structure and more reliable.

According to a preferred embodiment, distribution of liquid is substantially improved by several means. The drilled apertures in the prior art feed tube are replaced with laser cut slits, preferably having a long dimension that runs either parallel to or slanted with respect to the wick axis. These slits are made extremely thin, for example, not exceeding 0.020 inches. Because of their shape, these slits are much less likely to become clogged with loose fibers than round holes even of much larger diameter. The outside diameter of the feed tubed is preferably 0.25 inches or greater and the wall thickness between the inside of the feed tube and its outside is preferably 0.035 inches or greater.

BEST MODE OF CARRYING OUT THE INVENTION

This invention is an improvement upon the rotating wick structure shown in U.S. Pat. No. 4,429,990 cited above, which also describes its articulation and oil supply mechanisms. The disclosure of that patent is incorporated by reference herein.

Figure 1:
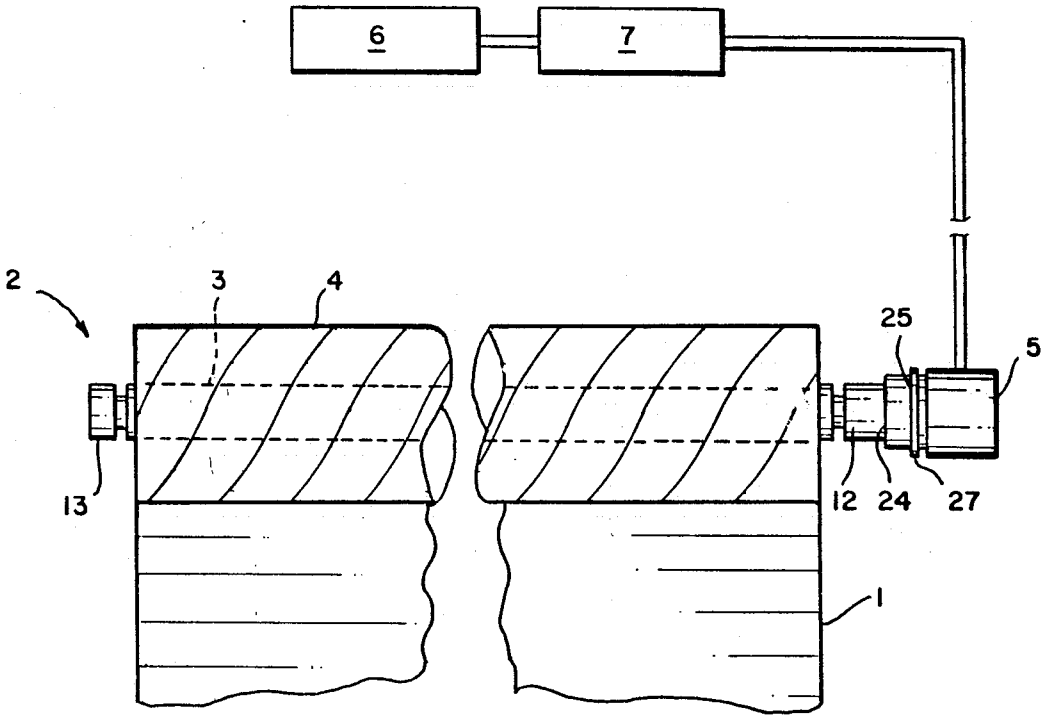
FIG. 1 is a partially schematic drawing showing a rotating wick oiling apparatus constructed according to the invention in its environment contacting a fixing roller.

According to FIG. 1 herein, release liquid, commonly called "fusing oil," is applied to the surface of a fixing or fusing roller 1 by a rotating wick 2 constructed according to the invention. The wick 2 is held in a yoke 30 (shown in FIGS. 6 and 7) which permits its rotation by the fusing roller 1. The wick includes a feed tube 3 and a porous covering 4. The feed tube is internally fed through a suitable coupling 5 with oil from an oil source 6 by a pump 7. The oil is distributed through openings in the feed tube 3 into the porous covering 4. The covering 4 is made of suitable capillary materials such as Nomex®, mentioned above, and cooperates with the feed tube to spread the oil evenly on the fusing roller surface. As in the prior art, the wick is articulatable to vary and control the amount of oil applied to the fusing roller surface.

Figures 2, 3, 4, 5, 6, 7, 15:
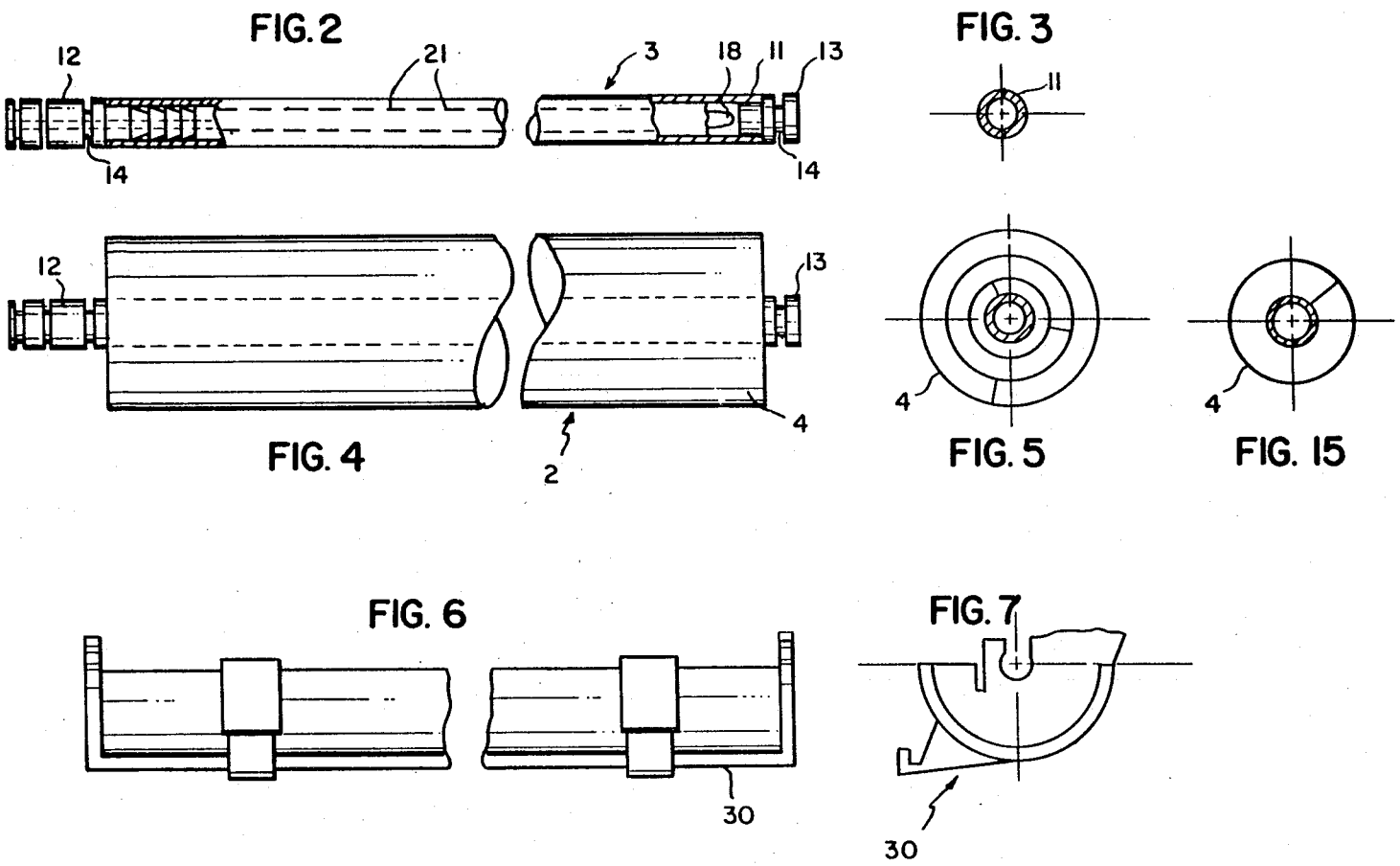
FIG. 2 is a side view of a feed tube constructed according to the invention with portions in section.
FIG. 3 is an end cross section of the feed tube shown in FIG. 2.
FIG. 4 is a side view of a fully assembled rotating wick constructed according to the invention.
FIGS. 5 and 15 are end cross sections of alternative embodiments of the wick shown in FIG. 4.
FIG. 6 is a side view of a yoke for rotatably holding and supporting articulation of the wick shown in FIG. 4.
FIG. 7 is an end view of the yoke shown in FIG. 6.
Figure 8:
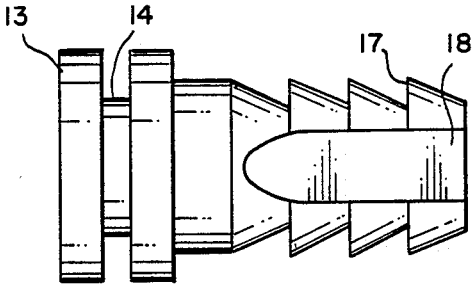
FIGS. 8 and 9 are side and end views, respectively, of a closed-end plug for the feed tube shown in FIG. 2.
Figure 9:
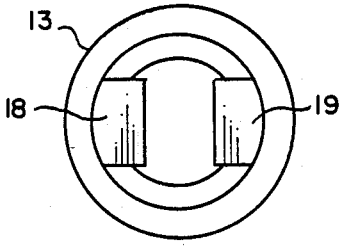
Figure 10:
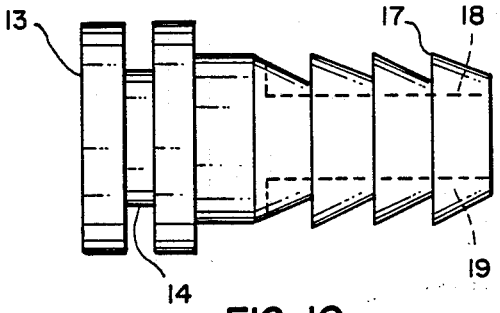
FIGS. 10 and 11 are side and end views of the plug shown in FIGS. 8 and 9 but rotated 90 degrees.
Figure 11:
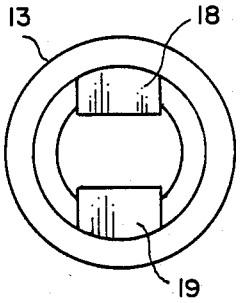
Figure 12:
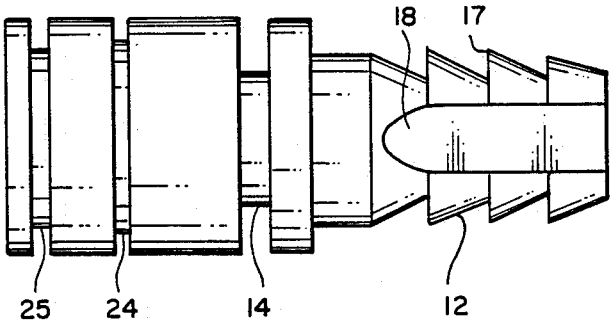
FIGS. 12 and 13 are side and end views respectively of a plug for the open end of the feed tube shown in FIG. 2.
Figure 13:
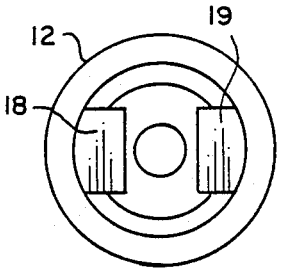

According to FIGS. 2 and 3, the feed tube 3 is made up of a relatively thick hollow tube 11 with plugs 12 and 13 in opposite ends. Plug 13 as shown in FIG. 2 is a closed-end plug which prevents oil from passing out of the right end and also provides a bearing surface 14 permitting rotation.

Plug 12 is similar to plug 13 except that it is hollow for supplying oil to the tube 11 and includes surfaces 24 and 25 which mate with coupling 5 to provide both oil tightness and rotatability while receiving oil through the feed system, as shown in FIG. 1. Surface 24 is recessed to receive a clamping structure 26. Surface 25 is also recessed to receive an O-ring 27 to assist in providing liquid tightness while permitting rotation of plug 12 with respect to coupling 5. Couplings of this type are generally available. For example, a suitable coupling 5 can be purchased from Component Supply, Ontario, N.Y., a division of Nova Sales Corporation.

The hollow tube 11 can be made of a number of materials, for example, aluminum, stainless steel or plastic. However, a preferred material, taking full advantage of the disposability feature is cardboard, for example, a phenolic-hardened cardboard. Oil is fed from inside the tube 11 through very narrow slits 21 which are preferably cut by a laser. Using slits instead of holes as in the prior art greatly reduces the tendency of the tube to clog with elongated fibers which flow through the slits better than through holes that may in fact be thicker in diameter.

For best distribution of oil from end to end of tube 11, especially when oil is fed from only one end as in FIG. 1, the tube itself is relatively large in outside diameter and has relatively thick walls, while the slits 21 are made extremely thin. More specifically, these slits are preferably not more than 0.020 inches in width, and may advantageously be between 0.005 and 0.007 inches in width. They can run parallel to the axis of tube 11, be slanted with respect to it or transverse to it. Slits parallel to the axis are preferred for ease in manufacturing and strength of the tube 11.

Preferably, the hollow tube 11 has an outside diameter 0.25 inches or more, for example, 0.375 inches and a wall thickness of 0.035 inches or more. For example, excellent fluid distribution has been obtained with walls 0.05 and 0.10 inches thick compared to walls in the prior art of 0.02 inches thick. These dimensions are substantially greater than the prior art and greatly enhance the evenness of distribution of the fluid from one end to the other of the tube 11.

The laser slit tube is covered with tightly and spirally wound layers of porous fabric 4 as shown in FIGS. 1, 5 and 15. Although a number of fabrics including wool would be satisfactory, spirally wound Nomex® is a preferred material. As shown in FIG. 1 the fabric is in the form of a strip and is wound much like a tennis racquet grip. It may be one layer as is shown in FIG. 15 or more than one as is shown in FIG. 5. If more than one layer is applied, best results will be obtained if the layers are joined by a suitable adhesive.

According to FIGS. 6 and 7 a yoke 30 receives bearing surfaces 14 in plugs 12 and 13 to support rotating wick 2 for both rotation and articulation.

The detail of plugs 12 and 13 are best shown in FIGS. 8 through 13. Plugs 12 and 13 may be manufactured of any multiple temperature resistant plastic. For ease of assembly, they include slanted ridges 17 that allow insertion in, but resist removal from tube 11. They each have two slices 18 and 19 which permit oil to access slits between the end of tube 11 and the inside extremity of the plug despite the presence of ridges 17. This particular construction allows the plug to be inserted fairly deeply into the tube 11 for stability and permanence but still allows slits along the entire tube to pass oil effectively.

Figure 14:
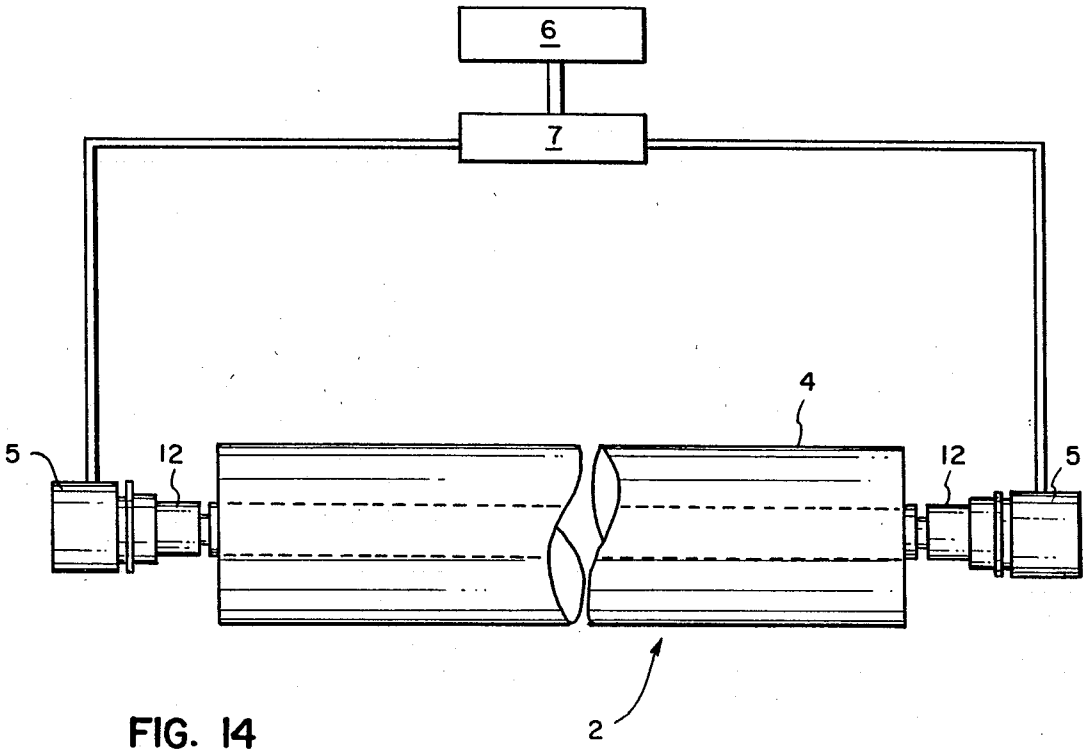
FIG. 14 is partial schematic of an alternative embodiment of the invention to that shown in FIG. 1.

FIG. 14 shows an alternative embodiment of the invention in which oil is fed from both ends. Open plugs 12 are used at both ends, and mate with liquid-tight couplings 5 at both ends.

The rotating wick described herein including both the feed tube 3 and the porous covering 4 is less expensive to manufacture than the prior art multilayer wick without the feed tube. Thus, not only is service less expensive, the permanent feed tube is eliminated as part of the original apparatus saving an element of expense in that apparatus. Since the new wick structure includes both porous material and feed tube as an integrated single structure, only one part need be purchased, stored and carried by field personnel. Openings in the permanent prior art feed tube occasionally become clogged, resulting in uneven oiling. The slits in the new structure are less likely to clog and the tube replaceability virtually eliminates the clogging problem. Thus, the new structure is more reliable. With the other parameters kept within the limits specified above, distribution of fluid is satisfactory along the length of the tube, even when feeding from one end as shown in FIG. 1. However, that distribution is still improved with the structure shown in FIG. 14 because of the uniformity in fluid pressure resulting from having the fluid fed from both ends.

The invention has been described in detail with particular reference to a preferred embodiment thereof, but it will be understood that variations and modifications can be effected within the spirit and scope of the invention as described hereinabove and as defined in the appended claims.

I claim:

1. A wick structure for use in a fixing device, the fixing device being of the type having a fixing surface to which release liquid is to be applied, a source for such release liquid, a feed means, and means for transporting such liquid through the feed means, said wick structure comprising:

a disposable feed tube connectable to an end of said feed means, said tube containing small slits through which said liquid can pass, said slits having a long dimension parallel to the wick axis, and a soft porous capillary material surrounding said feed tube.

2. The wick structure according to claim 1 wherein the slits have a width not exceeding 0.020 inches and an axial length of at least 0.10 inches.

3. The wick structure according to claim 1 wherein said feed tube has an outside diameter at least 0.25 inches and a wall thickness at least 0.035 inches.

4. The wick structure according to claim 3 wherein said wall thickness is approximately 0.05 inches.

5. A wick structure for use in a roller fixing device, generally of the type used to fix toner images in a copier or printer, the roller fixing device having a heated roller surface to which release liquid is to be applied, a source for such release liquid, and a means for transporting such liquid through a feed means, said wick structure being rotatable by said roller surface and comprising:

an elongated disposable cardboard feed tube connectable to said feed means, said tube containing apertures through which said liquid can pass, and soft porous capillary fabric wrapped around and in contact with said feed tube and contactable with said roller surface.

6. The structure according to claim 5 wherein said feed tube is a hollow tube with end plugs, at least one of said end plugs having a center passageway for liquid.

7. The structure according to 6 wherein said apertures are in the form of slits.

8. The structure according to 6 wherein said plugs include ridges securing the plugs in the hollow tube and said plugs further have at least one longitudinal recess in their exterior providing access for liquid to apertures in said tube behind said ridges.

9. A wick structure for use in a fixing device, the fixing device being of the type having a fixing surface to which release liquid is to be applied, a source for such release liquid, a feed means, and means for transporting such liquid through the feed means, said wick structure comprising:

a disposable feed tube connectable to an end of said feed means, said tube containing small apertures through which said liquid can pass, and at least two spirally wrapped layers of a soft porous capillary material joined together by an adhesive, and surrounding said feed tube.

10. A wick structure for use in a roller fixing device, generally of the type used to fix toner images in a copier or printer, the roller fixing device having a heated roller surface to which release liquid is to be applied, a source for such release liquid and means for transporting such liquid through a feed means, said wick structure being rotatable by said roller surface and comprising:

an elongated disposable feed tube connectable at both ends to said feed means, said tube containing apertures through which said liquid can pass, and soft porous capillary fabric wrapped around and in contact with said feed tube and contactable with said roller surface.

11. A wick structure for use in a roller fixing device, generally of the type used to fix toner images in a copier or printer, the roller fixing device having a roller surface to which release liquid is to be applied, a source for such release liquid, and means for transporting such liquid under pressure through a feed means, said wick structure being rotatable by said roller surface and comprising:

an elongated disposable feed tube connectable to said feed means, said tube containing apertures through which said liquid can pass, and said feed tube having an outside diameter at least 0.25 inches and a wall thickness at least 0.035 inches, and soft porous capillary fabric wrapped around and in contact with said feed tube and contactable with said roller surface.

12. The wick structure according to claim 11 wherein said apertures have a dimension which does not exceed 0.020 inches.

13. The wick structure according to claim 11 wherein said wall thickness is approximately 0.05 inches.

* * * * *